United States Patent [19]

Herrin

[11] Patent Number: 4,578,054

[45] Date of Patent: Mar. 25, 1986

[54] CARTON ERECTION AND SEALING APPARATUS

[76] Inventor: Robert M. Herrin, P.O. Box 4509, Albany, Ga. 31706

[21] Appl. No.: 552,678

[22] Filed: Nov. 17, 1983

[51] Int. Cl.[4] ..... B31B 1/06; B31B 3/00; B31B 5/00

[52] U.S. Cl. ..... 493/126; 493/131; 493/144; 493/167; 493/179; 493/309

[58] Field of Search ..... 493/309, 310, 126, 128, 493/131, 167, 169, 179, 144

[56] References Cited

U.S. PATENT DOCUMENTS

| | | | |
|---|---|---|---|
| 3,748,972 | 7/1973 | Barton | 493/126 |
| 4,018,143 | 4/1977 | Dice | 493/131 |
| 4,133,254 | 1/1979 | Odom et al. | 493/128 |
| 4,160,406 | 7/1979 | Nowalki | 493/128 |
| 4,348,853 | 9/1982 | Morse et al. | 493/126 |
| 4,439,174 | 3/1984 | Derderian | 493/126 |

*Primary Examiner*—Leonidas Vlachos

*Assistant Examiner*—Jerry Kearns

*Attorney, Agent, or Firm*—Duckworth, Allen, Dyer & Pettis

[57] ABSTRACT

Apparatus for opening flattened cartons having a pair of minor flaps and a pair of major flaps. A constant speed conveyor carries a horizontally disposed flattened carton across an actuator having a cam surface. The cam surface moves upward to fold one pair of major and minor flaps upward and then downward to fold the other pair of major and minor flaps downward. A clamp grasps the upward folded major flap and draws it upward as the conveyor moves the carton forward causing the carton to open. The clamp releases the major flap and the carton moves past a glue gun which applies glue to the minor flaps. A pair of curl bars folds the major flaps against the glue coated minor flaps. An extending platen presses the flaps against a roller bank permitting the glue to set. The platen retracts and the opened and bottom-sealed carton is completed.

11 Claims, 19 Drawing Figures

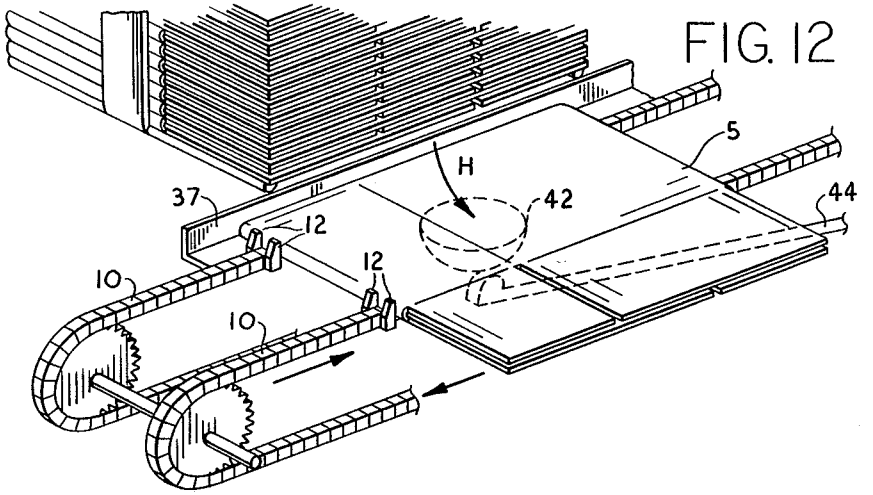
FIG. 12
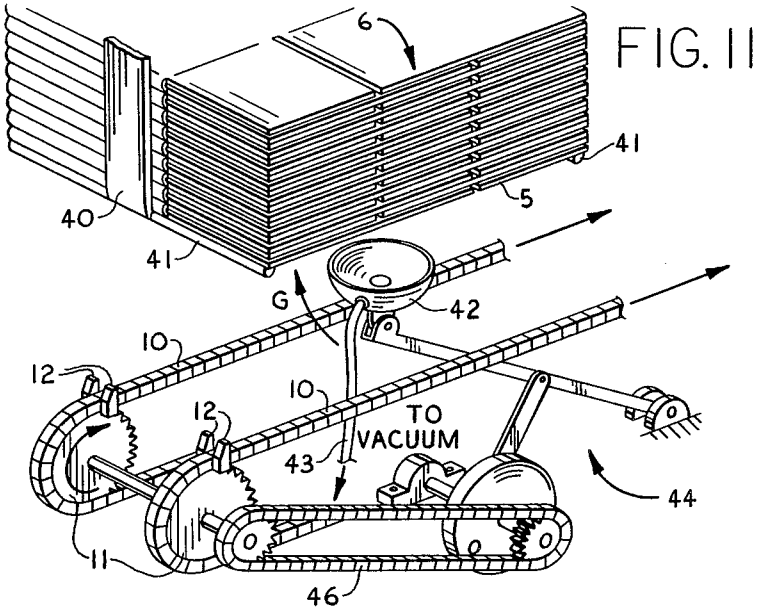
FIG. 11
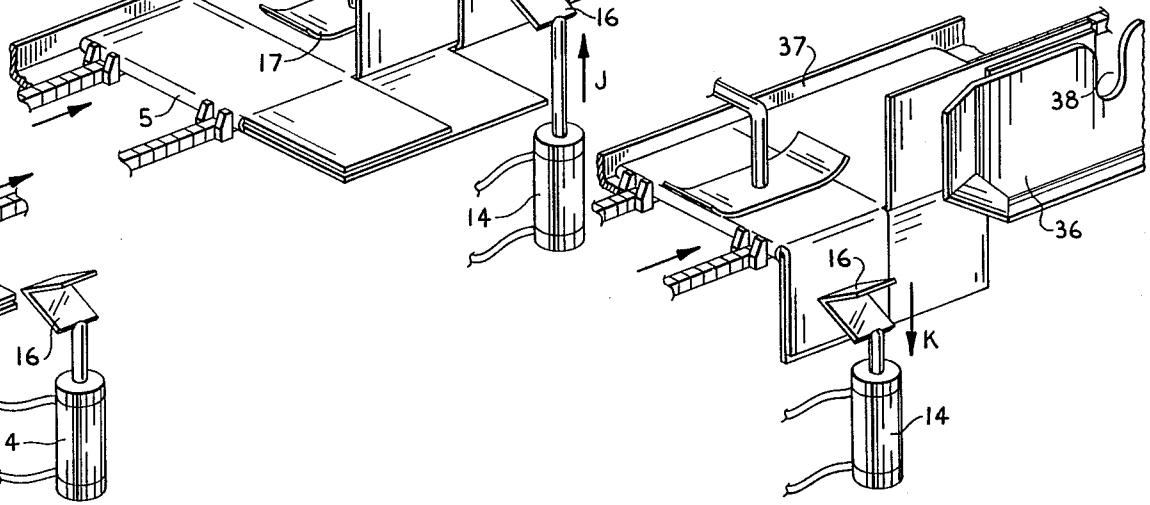
FIG. 15
FIG. 14
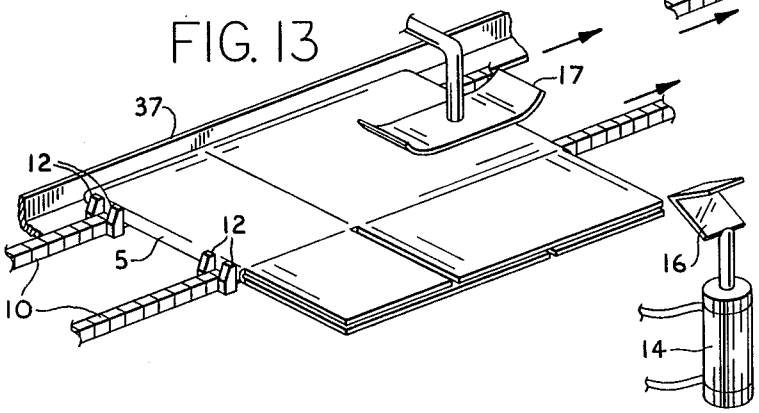
FIG. 13

CARTON ERECTION AND SEALING APPARATUS

BACKGROUND OF THE INVENTION

1. Field of the Invention

The present invention is related to apparatus for automatically opening flat packed cartons, and folding and sealing the flaps; and more particularly, to such apparatus having a high throughput.

2. Description of the Prior Art

Rectangular cartons formed from corrugated cardboard and the like are generally packed flat by the manufacturer and bundled for storage and transport. The user is therefore required to open up or erect the flattened and folded carton, properly orient and fold the bottom flaps, apply glue thereto, and fold the flaps to form a sealed bottom of the carton. Although such operations can be performed manually, the costs are generally prohibitive for high volume operations. Consequently, a wide variety of complex machinery has been developed to perform such operations automatically.

In a typical prior art apparatus for this purpose, the handling of the cartons is accomplished utilizing suction cups in performing the various operations. Difficulty is encountered due to leakage of a cup which may interrupt the sequence of operation and require manual attention. Such machines usually work in a stop-and-go fashion; that is, the carton is moved from one station to another, stopped at the station until a particular operation is completed, and then moved to another station. This mode of operation is relatively slow. The intermittent operation also produces wear on the controlling mechanisms requiring constant maintenance.

SUMMARY OF THE INVENTION

The present invention is an improved automatic apparatus having a continuously moving conveyor with all erecting, folding, and gluing operations performed while the carton is in motion. This technique increases the throughput of the apparatus as compared to prior art machines and reduces maintenance by eliminating stop and go movements, yet utilizes relatively few operating elements. A carton to be erected and sealed is rectangular in shape having a pair of minor bottom flaps attached to the short sides and a pair of major bottom flaps attached to the long sides.

The apparatus may be conveniently divided into four sections. The first section feeds flattened cartons from a hopper to a conveyor which is preferably of the chain type.

Next, a flap folding section is provided in which the flattened carton is held against the conveyor and a hydraulic actuator folds one pair of minor and major flaps downward and the other pair of minor and major flaps upward. As the carton moves forward, the folded flaps are maintained in the up and down positions by a retaining plate.

The carton is moved to an erection section at which point a clamp on an articulated arm assembly grasps the upturned major flap and moves vertically, pulling the flap and the attached long side upward. The rate of upward motion is matched to the forward speed of the conveyor with the net result that the carton is fully opened when the clamp gets to its uppermost position at which time the clamp releases. At this stage, the carton has been erected to a rectangular configuration with the major flaps folded upward and downward, and the minor flaps folded inward. As will be understood, the carton is lying on a long side with its top open.

The final section of the apparatus is the gluing station which applies glue to the minor flaps, folds in the major flaps, and applies pressure to the flaps until the glue has set. As the carton moves into the gluing section, an overhead conveyor having a set of dogs contacts the upper corner of the carton to assist in maintaining the movement and orientation of the carton. The carton then moves by a glue gun which, operating under air pressure, applies several lines of glue onto the outside surface of the minor flaps. As the carton leaves the glue gun, a pair of curl guides catches the upward and downward folded major flaps and, due to the forward movement of the carton by the conveyor, folds these flaps inward against the glue-coated minor flaps. Simultaneously, a platen, matching the size of the minor flaps and mounted to a horizontally movable arm, moves into the open top of the carton until it contacts the inside surfaces of the minor flaps. As will be understood, the platen is moving forward in the same direction and at the same rate as the carton conveyor belt.

At the point the platen contacts the minor flaps, the carton has moved to a set of vertical rollers which contact the folded in major flaps. Therefore, pressure exerted by the platen forces the minor and major flaps against the rollers. The length of the bank of rollers is sufficient such that, when the platen and carton reach the opposite end, the glue will have set. At that point, the platen retracts and the conveyor moves the erected and sealed bottom carton onto a conveyor belt which may carry the carton to a point of use.

As may now be recognized, the apparatus of the invention provides a relatively simple straight line operation in which each carton moves at a constant rate along the path of the machine with no requirement for stopping and starting of the moving parts of the machine. This feature permits rapid motion and high throughput. For example, speeds of 40 to 60 cartons per minute are possible.

It is therefore a principal object of the invention to provide apparatus for automatically erecting a flattened or folded cardboard carton, and folding and sealing the bottom flaps.

It is another object of the invention to provide a carton erecting and sealing apparatus in which the carton moves at a constant rate through the operations of the apparatus.

It is yet another object of the invention to provide a carton erecting and sealing apparatus in which the carton is erected by means of a vertical force coupled with a forward movement of the carton.

It is still another object of the invention to provide an apparatus in which opening of the carton is accomplished by grasping a major flap of the carton and drawing the flap upward as the carton moves horizontally.

These and other objects and advantages of the invention will become apparent from the following detailed description when read in conjunction with the drawings.

BRIEF DESCRIPTION OF THE DRAWINGS

FIG. 2 shows the upward folding of a first pair of flaps;

FIG. 3 shows the downward folding of a second pair of flaps;

FIG. 4 shows the grasping of the upward folded major flap;

FIG. 5 shows the erection of a carton by an upward pull on the major flap;

FIG. 6 shows coating of the minor flaps with glue;

FIG. 7 shows the folding in of the major flaps;

FIG. 8 shows a platen providing pressure on the glued flaps against a bank of rollers;

FIG. 11 is a partial schematic view of the feed system for depositing a folded carton on the conveyor;

FIG. 12 shows the depositing of a carton on the conveyor;

FIG. 13 shows the flap folding station with hold down means for securing the carton during the folding operation;

FIG. 14 shows details of the upward flap folding operation;

FIG. 15 shows details of the downward flap folding operation and the use of the retaining plate;

DETAILED DESCRIPTION OF THE PREFERRED EMBODIMENT

Figure 1:
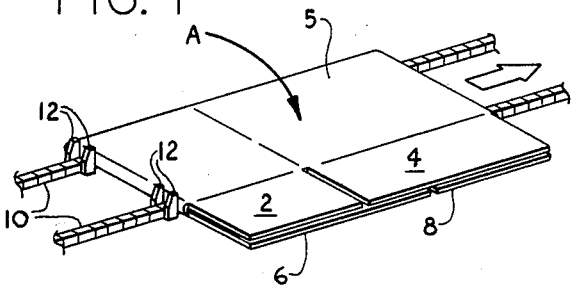
FIGS. 1 through 8 show in simplified form the various operations on a carton in accordance with the invention, with FIG. 1 showing a folded and flattened carton having been deposited on a conveyor.

Referring first to FIGS. 1 through 8, the basic principles of operation of the apparatus will be described before discussing the machine as a whole. A typical carton of the type for which the machine is eminently suited is shown in FIGS. 1 at 5. Carton 5 is of the type used to pack citrus, vegetables, and the like which, when in use, is in the form of a rectangular carton having an open top. After filling, a separate cover is installed. Carton 5 is formed from corrugated cardboard and is delivered in the flattened or folded condition as shown. It is to be understood that the carton is taped or sealed at one edge as is well known in the trade. Carton 5 includes four flaps, with flaps 2 and 8 referred to as minor flaps, and flaps 4 and 6 referred to as major flaps. In accordance with the invention, carton 5 is deposited as indicated by arrow A on a moving conveyor 10, having a pair of dogs 12, which serves to move carton 5 along the conveyor 10 in the direction of the solid arrow. Carton 5 is thus disposed on conveyor 10 in a horizontal plane.

Figure 2:
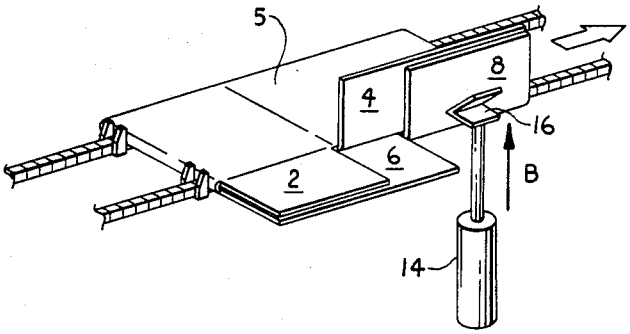
Figure 3:
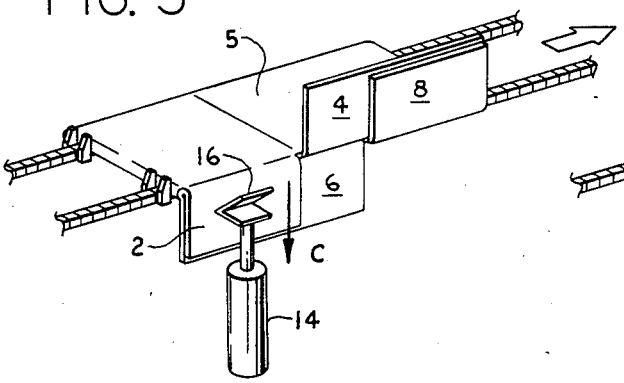
Figure 4:
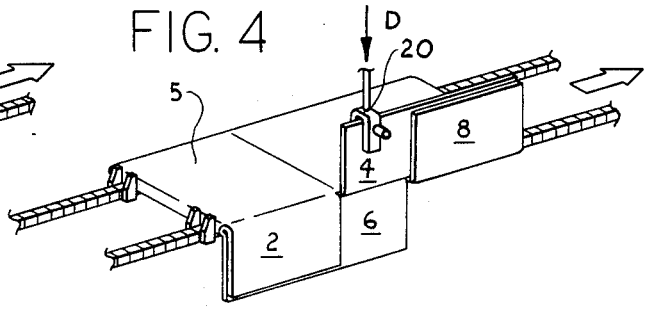

In FIG. 2, carton 5 is moved to the flap breaking or folding station at a continuous rate. As the carton arrives at the position shown, an actuator 14, having a cam surface 16 attached to actuator rod 15, extends upward contacting lower minor flap 8, folding minor flap 8 and major flap 4 upward as the cam surface 16 moves in the direction indicated by arrow B. As conveyor 10 continues to move carton 5 forward, actuator 14 retracts when cam 16 is over minor flap 2 as indicated by arrow C, folding minor flap 2 and major flap 6 downward. Although omitted for clarity, upward folded flaps 4 and 8 are captivated by a retaining plate to be described hereinbelow which serves to maintain the flaps in the folded condition. As conveyor 10 continues to move, downward folded flaps 2 and 6 are caught by the retaining plate.

Figure 5:
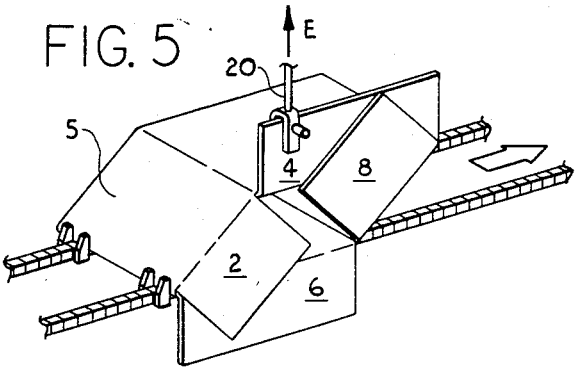

Next, carton 5 is carried by conveyor 10 to an erecting station at which point a set-up clamp 20 is moved downward over major flap 4 as indicated by arrow D. Clamp 20 includes an air-operated actuator 29 which causes it to firmly grip major flap 4. As conveyor 10 continues to move in the forward direction, clamp 20 prevents major flap 4 from moving forward. As indicated in FIG. 5 by arrow E, claim 20 is raised upward. The rate of upward movement is controlled to complement the rate of forward movement of conveyor 10 with the result that dogs 12 force the lower side of carton 5 to move forward and carton 5 to begin to open as shown in FIG. 5. As may be recognized, minor flaps 2 and 8 maintain their relative position with respect to the short sides of carton 5 and rotate to the position seen in FIG. 6. Clamp 20 releases when carton 5 is fully erected. After erection, an upper conveyor 50 having dog 52 contacts the upper rear corner of carton 5. Dog 52 serves to maintain the carton in the erect position for subsequent sealing of the bottom flaps.

Figure 6:
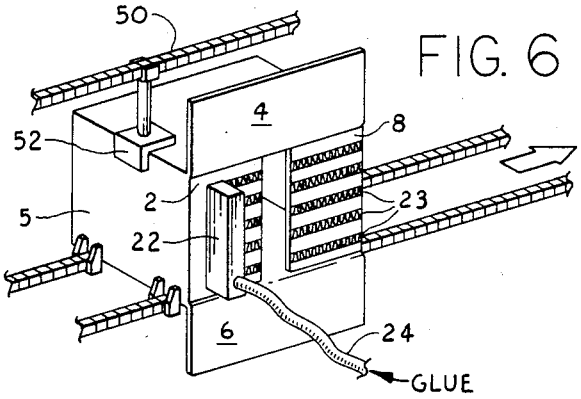

As seen in FIG. 6, carton 5 is moved by the conveyors 10 and 50 past a glue gun 22. Glue gun 22 utilizes a fast setting liquid glue and is energized during the time that minor flaps 8 and 2 pass the gun 22. Thus, several stripes of glue 23 are applied to flaps 8 and 2 as carton 5 moves across gun 22.

Figure 7:
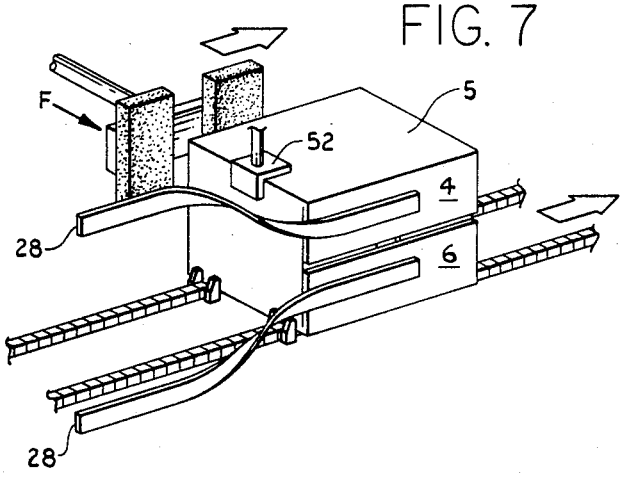
Figure 8:
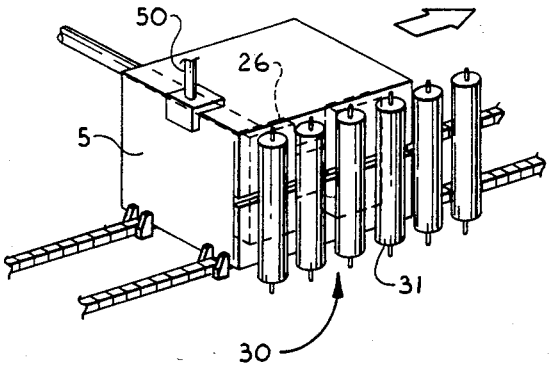

After coating of the minor flaps 8 and 2 with glue, major flaps 4 and 6 are caught by curl guides 28 which cause flaps 4 and 6 to be folded in against minor flaps 8 and 2 as shown in FIG. 7. At this point, a platen 26, which is moving in the same direction and at the same rate as conveyor 10 as indicated by the solid arrow, is moved into the open end of box 5 as indicated by arrow F. Carton 5 is then moved to a bank of rollers 30 comprising a plurality of rollers 31, as seen in FIG. 8, which contacts major flaps 4 and 6. Thus, roller bank 30 acts as a backup for platen 20. As this contact is made, platen 26 is pressed firmly against the inner sides of minor flaps 8 and 2 forcing these flaps and the major flaps 4 and 6 against rollers 30. Although not shown in FIG. 8, the bank of rollers extends for a sufficient distance to permit setting of the glue 23 as the carton and platen traverse rollers 30.

Having now explained the basic principle of operation of the invention, the overall apparatus will be described with reference to FIGS. 9 and 10. In the elevation view of FIG. 9, only the main operating elements are shown, and the framework, supporting structures, and the like have been omitted for clarity but will be obvious to those of skill in the art. Where appropriate, stationary elements have been indicated by the ground symbol. Conveyor 10 is driven by sprockets 11 and 13 and carry a plurality of dogs 12 along the conveyor 10. Dogs 12 are accurately spaced to ensure synchronous operation of the machine. Dogs 12 are bifurcated and ride on support bar 46. A hopper 40 is provided which supports a stack 6 of folded cartons 5. A suction cup 42, having a line 43 to a vacuum source via a cut-off valve not shown, is operated by an articulated arm and crank 44. As will be shown in more detail hereinafter, cup 42 is pressed against the bottom carton 5 in stack 6, suction applied, and the arm withdrawn. This pulls the flattened carton from the bottom of the stack and deposits it on conveyor chain 10 as earlier shown in FIG. 1 as the dog 12 is in the appropriate position. The deposited carton is carried to the flap breaking or folding station in which the carton passes below shoe 17. Shoe 17 serves to hold the carton against conveyor 10 as actuator 14 moves flap folding cam 16 upward and downward as previously discussed. After the flaps are folded, the carton moves behind retaining plate 36 which holds the flaps in the folded positions for the following operations. As best seen from the top view of FIG. 10, plate 36 has its forward edge bent outward to capture the folded flaps. Actuator 29 on clamp 20 is connected by line 39 to a compressed air supply via an air valve not shown. Clamp 20 is supported by a four bar linkage 21 operated by concentric crank element 34. An opening 38 is provided in retaining plate 36 to permit clamp 20 access to the upward folded major flap of a carton progressing along the line.

Just beyond the retaining plate 36, glue gun 22 is mounted. A source of liquid hot glue 33 is provided and connected to gun 22 by means of hose 24. A compressed air system (not shown) is actuated when the carton is in the proper position in front of glue gun 22 and is timed to eject glue as the minor flaps move in front of the gun 22. A platen 26, having two pads 27 which are preferably of a material such as Teflon®, may be seen at that point in a retracted position. As noted from the top view of FIG. 10, platen 26 is attached to platen arm 70 which slides in tube 74. Tube 74 is attached to a pair of chains 61 driven at the same rate as conveyor 10. Thus, platen 16 moves along with the carton. Chains 61 support four platens 26 although only two are shown in the figure. Tube 74 includes a slot 71 through which projects a pair of cam followers 72 which engage cam track 64.

As chains 61 move in the direction of the arrow, cam track 64 causes platen arm 70 to extend as a carton moves from the glue gun position along roller bank 30 and retracts after the glue sets. The spacing of dogs 12 on conveyor 10 is matched to the spacing of platen tubes 74 which synchronizes platens 26 with the cartons.

Following the glue gun 22 is a pair of curl guides 28 for closing the major flaps over the glue-coated minor flaps. As the major flaps are closing, platen 26 is extending into the carton. Timing is selected such that the carton bottom contacts roller bank 30 as platen 26 contacts the inner surfaces of the minor flaps. The forward portion of cam track 64 maintains platen 26 tightly against the carton bottom.

Figure 9:
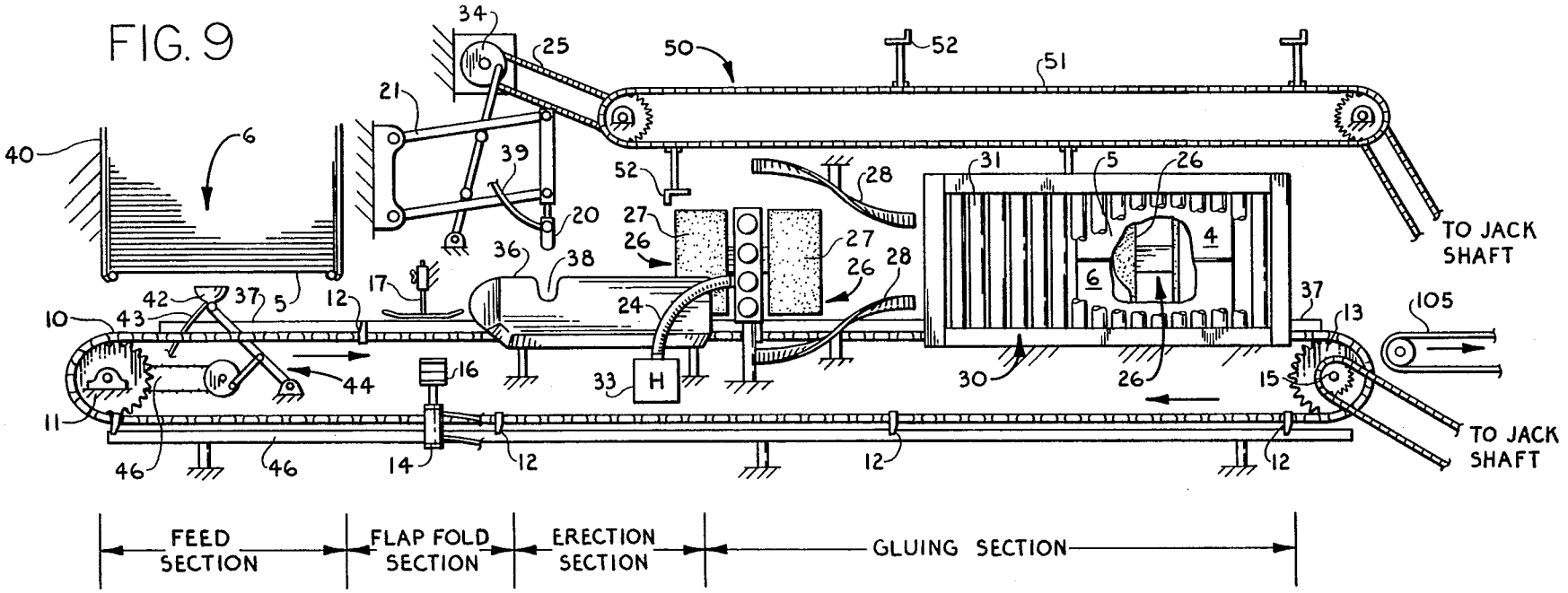
FIG. 9 is a schematic elevation view representation of the major elements of the invention.

In FIG. 9, roller bank 30 and carton 5 are partially cut away, disclosing platen 26 in its fully extended position. As carton 5 is carried forward from the position shown, platen 26 retracts and carton 5 is moved off the end of conveyor 10 onto belt conveyor 105 for delivery of the completed carton.

Figure 10:
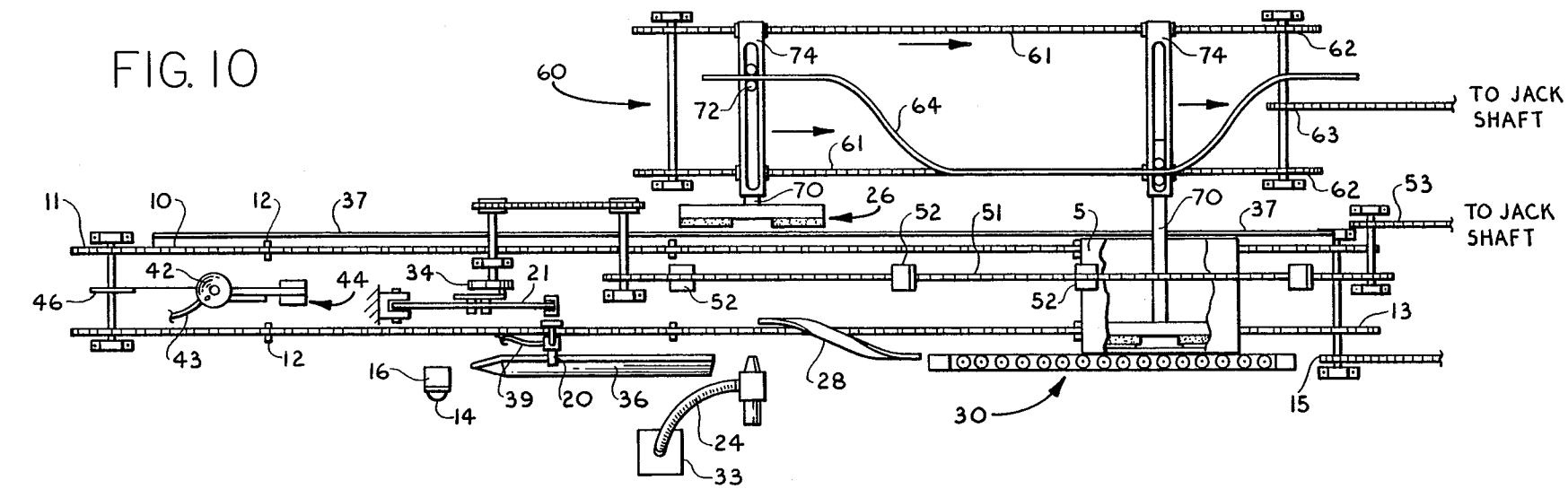
FIG. 10 is a plan view of the schematic of FIG. 9.

FIGS. 9 and 10 also show the preferred methods of driving the conveyors, chains, and eccentric crank assemblies of the invention, although other means will be obvious to those of skill in the art. Conveyors 10 and 50 are driven from a common jack shaft not shown. A power take off 25 from conveyor 50 operates crank assembly 34 for clamp 20. A power take off 46 from conveyor sprockets 11 drives carton feeder arm 44.

Having now presented an overall description of the preferred embodiment of the invention, additional details of the elements thereof will be provided. Turning to FIGS. 11 and 12, the carton feed system is illustrated. The hopper consists of a pair of support bars 40 having rods 41 welded to a lower end. One support bar 40 is preferably adjustable to permit setting to hold various size cartons. Feeder arm 44 is driven by power take off 46 from sprockets 11. The speed of operation of arm 44 is selected to produce one cycle as each dog 12 passes stack 6. As vacuum cup 42 contacts the bottom carton 5 of stack 6, vacuum is applied via line 43. When arm 44 retracts, carton 5 is pulled past rods 41 down to conveyor 10 as seen in FIG. 12, arrow H. At this point, the vacuum on line 43 is cut off, releasing carton 5. An angle iron guide 37 is provided for the top edge of carton 5.

In FIG. 13, carton 5 is shown approaching flap breaking actuator 14 which is in its full retracted position. A shoe 17 is provided for holding carton 5 against conveyor 10 during the flap folding operation. FIGS. 14 and 15 illustrate the flap breaking operation. Retainer plate 36 has its leading edge flared outward to catch the folded flaps and hold the flaps in the folded positions. Cut out 38 may be noted which provides access to the upward folded flaps for clamp 20.

Figure 16:
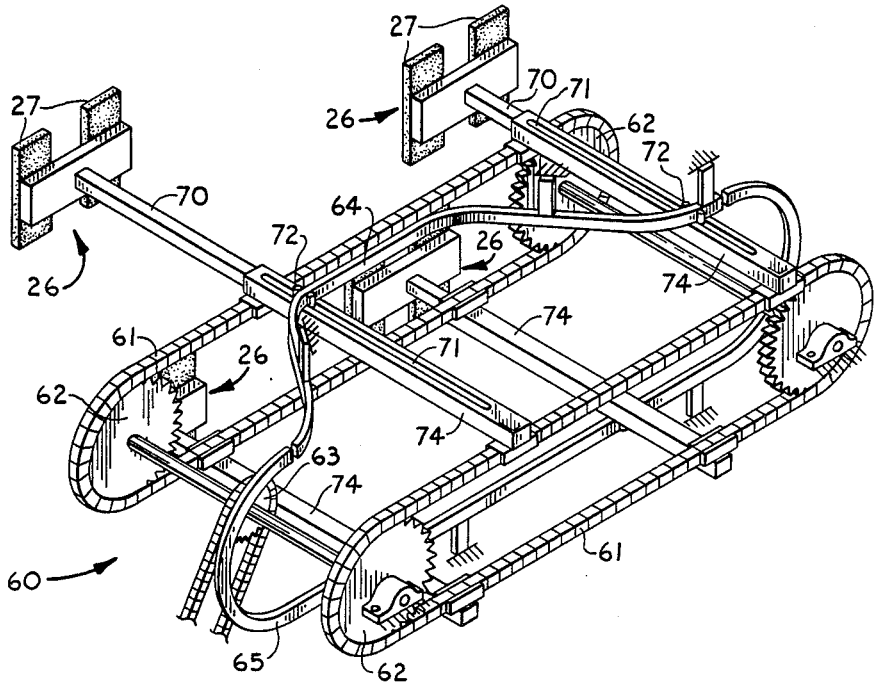
FIG. 16 shows a schematic view of the platen operating mechanism of the invention.
Figure 17:
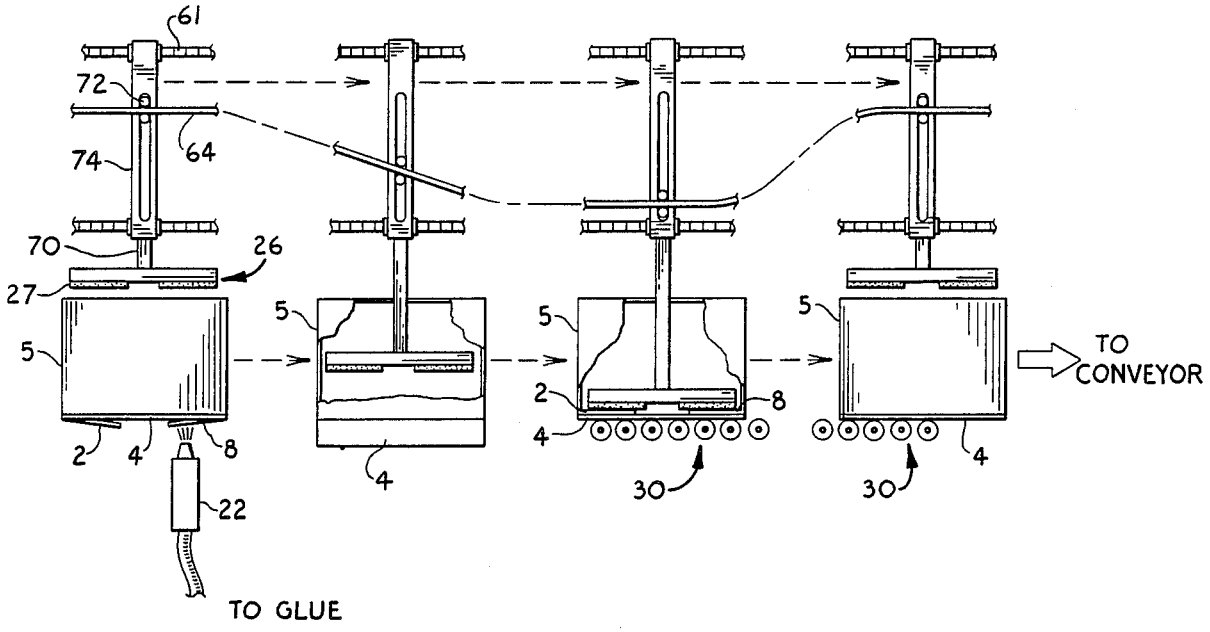
FIG. 17 illustrates schematically the sequence of movement of the platen during a typical gluing operation.

Details of platen drive assembly 60 are shown in FIG. 16. Four platen tubes 74 are mounted with equal spacing around drive chains 61. As previously discussed, cam track 64 engages cam followers 72 on platen rods 70 which causes the two upper platens 26 to extend and retract. A straight cam track 65 maintains the inactive platens retracted as they are returned to the forward end of the assembly. In FIG. 17, the operation of the platen drive assembly 60 is shown by following the movement of carton 5. After carton 5 leaves the glue gun station, cam track 64 moves platen 26 into the open end of carton 5 and applies pressure against the glue-coated flaps and roller bank 30. As carton 5 leaves roller bank 30, platen 26 retracts.

Figure 18:
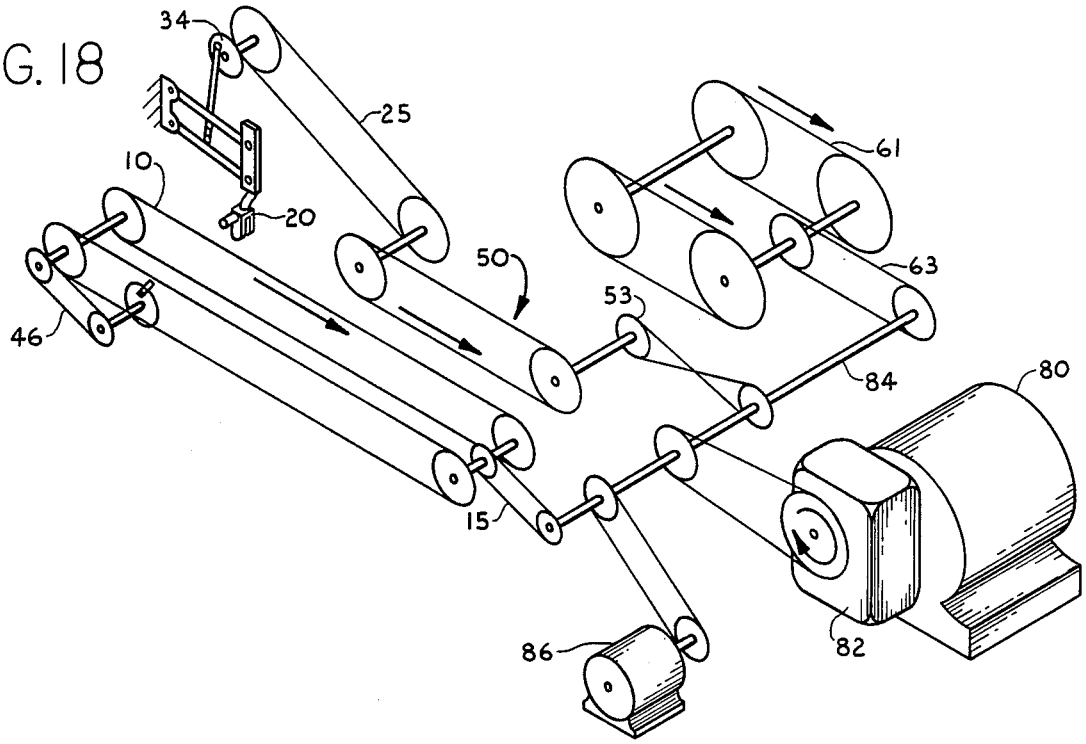
FIG. 18 is a schematic diagram of the drive system of the invention.

FIG. 18 is a schematic diagram of the power distribution system of the invention. The prime mover is preferably an electric motor 80 having a gear reduction assembly 82. An adjustable speed motor is preferred to permit control of the system throughput. The output from reduction assembly 82 drives, via chain and sprocket, jack shaft 84 which drives the major subassemblies: main conveyor 10, upper conveyor 50; and platen drive assembly 60. Power take off 25 from upper conveyor 50 operates clamp eccentric 34 and power take off 45 drives vacuum cup arm 44.

Figure 19:
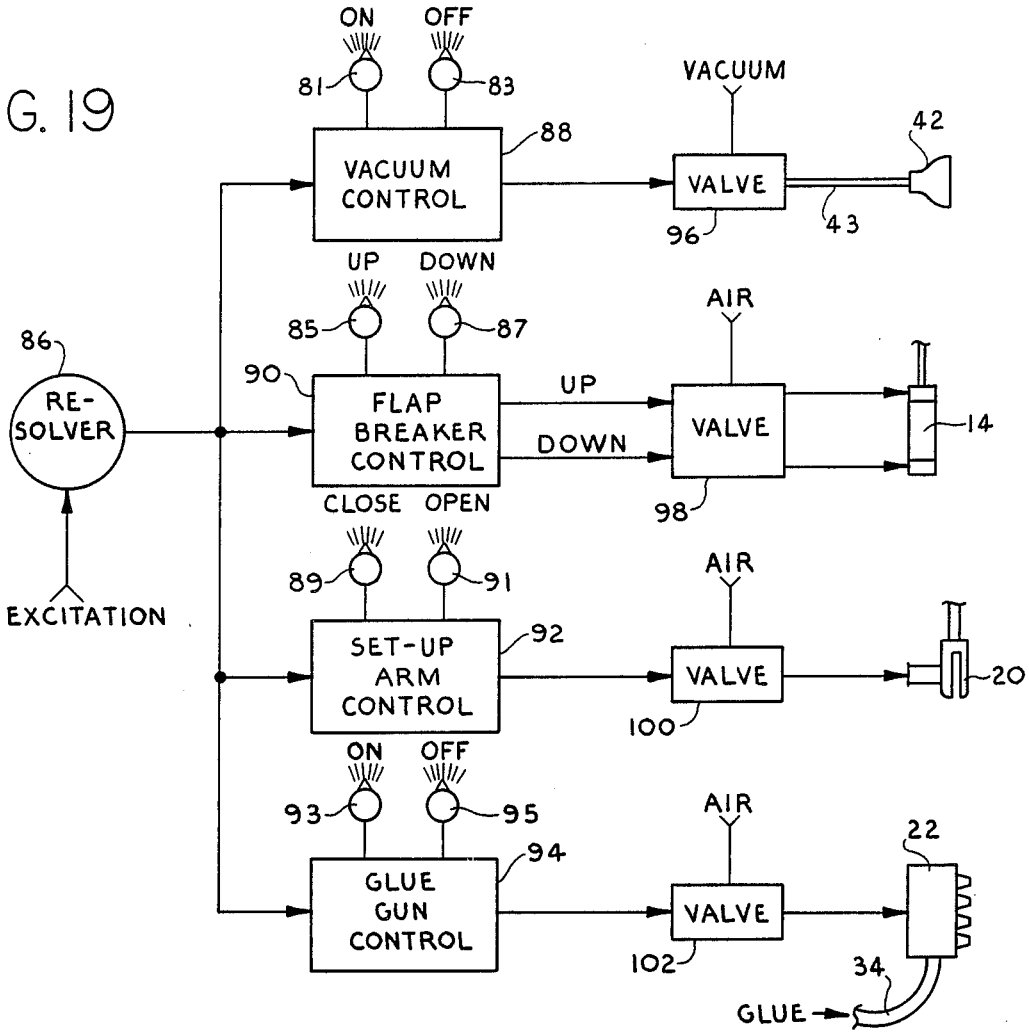
FIG. 19 is a block diagram of the timing and control system of the invention.

As may now be seen, all of the operations of the apparatus are mechanically linked and therefore operate in correct synchronism without critical adjustment. However, it is necessary to accurately control certain sub-operations. To this end, an electronic control system is provided. As seen in FIG. 18, a resolver 86 is coupled to jack shaft 84 and geared to make one revolution during the passage of one carton from start to finish. FIG. 19 is a block diagram of the control system.

Resolver 86 produces an output signal with a phase relationship proportional to the angle of the shaft with respect to a reference position. A set of electronic phase detectors is provided and calibrated to produce control signals at the required times. Each signal is controllable over a narrow range by means of trimmer controls.

The vacuum control circuit 88 serves to turn on valve 96 placing a vacuum line 43 to cup 42. Control 81 permits accurate adjustment to energize cup 42 as it contacts a carton in stack 6. The off control 83 permits setting release of the transferred carton as it is deposited on the conveyor.

Flap breaker control 90 operates valve 98 which applies air to actuator 14 to extend and retract when the carton is in the proper position. Controls 85 and 87 allow fine control of the up and down movement of actuator 14.

Clamp 20 requires accurate energizing to ensure that a carton is released at the moment it is fully opened. Set-up arm control turns air valve 100 on and off with controls 89 and 91 independently adjusting closing and opening times of valve 100.

Exact control of glue gun 22 is required to prevent leakage of glue or insufficient glue. The on-off points of air valve 10 are controlled by controls 93 and 95 to select the proper timing of glue gun 22.

It is to be understood that the apparatus described above can include numerous adjustments to permit handling of cartons over a range of sizes. Although specific arrangements and designs have been disclosed, it is to be understood that such are for exemplary purposes only and many modifications and substitutions may be made by those of skill in the art without departing from the spirit and scope of the invention.

I claim:

1. Apparatus for erecting and sealing flattened cardboard cartons, said cartons having a pair of major flaps and a pair of minor flaps, comprising:

a. conveyor means for moving an initially flattened carton forward at a constant rate, said flattened carton disposed on said conveyor means in a horizontal plane;

b. flat folding means cooperating with said conveyor means for folding a first pair of a minor flap and a major flat upward and a second pair of a minor flap and a major flap downward;

c. mechanical clamping means for grasping both sides of the upward folded major flap;

d. erecting means for drawing said clamping means upward as said conveyor means moves said carton forward thereby opening said carton, said erecting means releasing said clamping means when said carton is fully open;

e. means maintaining said container in an erect condition during said movement, f. glue applying means adjacent said conveyor means for applying glue to said minor flaps as said carton moves past said glue applying means;

g. major flap folding means for folding said upward and downward folded flaps inward and in contact with said glue on said minor flaps;

h. platen means moving in said direction and at the same rate as said conveyor means, said platen means extending into said carton for contacting the inside surfaces of said minor flaps after folding in of said major flaps; and i. platen backing means adjacent said conveying means for contacting said folded in major flaps as said conveying means moves said carton along said platen backing means, said platen means applying pressure to said minor and major flaps against said platen backing means.

2. The apparatus as defined in claim 1 which further comprises:

carton hopper means for holding a stack of flattened cartons; and carton depositing means for sequentially depositing cartons from the stack onto said conveyor means.

3. The apparatus as defined in claim 1 in which said conveyor means includes a pair of parallel sprocket driven first chains spaced apart and having a plurality of dogs attached thereto, said dogs adapted to contact edges of cartons disposed on said chains.

4. The apparatus as defined in claim 2 in which said flap folding means includes:

hold down means for holding said flattened carton against said chains;

actuator means having a cam surface for contacting said flaps, said actuator controlled to move upward when the minor flap of said first pair of flaps is over said cam surface, and to move downward when the minor flap of said second pair of flaps is below said cam surface; and retaining plate means adjacent said pair of chains for captivating said upward and downward folded flaps.

5. The apparatus as defined in claim 1 in which said erecting means includes:

eccentric crank means;

said clamping means connected to said eccentric crank means whereby said crank means lowers and raises said clamping means; and clamp control means for closing said clamping means onto said major flap when said clamping means is in a lower position and releasing said clamping means from said major flap when said clamping means is in a raised position.

6. The apparatus as defined in claim 3 in which said conveyor means further includes:

a sprocket driven overhead chain disposed above and parallel to said pair of first chains;

a plurality of second dogs disposed along said overhead chain, one of said second dogs adapted to contact the upper edge of each erected carton for assisting movement of such carton.

7. The apparatus as defined in claim 1 in which said glue applying means includes:

a glue gun disposed adjacent said conveyor means;

hot glue supply means;

a hose connecting said hot glue supply means to said glue gun; and air valve means for providing pressurized air to said glue gun.

8. The apparatus as defined in claim 2 in which said platen means includes:

an endless sprocket driven chain parallel to and moving at the same rate as said conveyor means;

a plurality of extendable bars attached to said endless chain;

a platen disposed at the distal end of each of said bars;

a cam track disposed adjacent said endless chain; and a set of cam followers attached to each of said bars and engaged with said cam track, said cam track causing said bar and platen to extend into said carton and to retract from said carton.

9. The apparatus as defined in claim 1 which further includes timing means for controlling the timing of each function of said apparatus.

10. The apparatus as defined in claim 9 in which said timing means includes resolver means coupled to and operated from said conveyor means, said resolver adapted to make one revolution during the movement of one carton over the length of said conveyor means.

11. The apparatus as defined in claim 10 in which said timing means further includes a plurality of phase detecting means for detecting preselected phases of the output of said resolver for controlling the time of operation of said flap folding means, said clamping means, and said glue applying means.

* * * * *